US009433310B1

(12) United States Patent
Roig

(10) Patent No.: US 9,433,310 B1
(45) Date of Patent: Sep. 6, 2016

(54) SLEEVE SYSTEM FOR BEVERAGE CONTAINERS

(71) Applicant: Gustavo A. Roig, Coral Gables, FL (US)

(72) Inventor: Gustavo A. Roig, Coral Gables, FL (US)

( * ) Notice: Subject to any disclaimer, the term of this patent is extended or adjusted under 35 U.S.C. 154(b) by 0 days.

(21) Appl. No.: 14/809,879

(22) Filed: Jul. 27, 2015

(51) Int. Cl.
*A47G 19/22* (2006.01)
*G09F 3/02* (2006.01)

(52) U.S. Cl.
CPC ... *A47G 19/2227* (2013.01); *G09F 2003/0251* (2013.01); *G09F 2003/0273* (2013.01)

(58) Field of Classification Search
CPC ..... A47G 19/2227; G09F 2003/0251; G09F 2003/0273
See application file for complete search history.

(56) References Cited

U.S. PATENT DOCUMENTS 5,325,991 A * 7/1994 Williams ..... A45F 5/02 215/12.1
5,871,184 A * 2/1999 Kaopio ..... A61J 9/06 248/102
5,927,524 A * 7/1999 Miller ..... A61J 9/08 206/459.5
6,128,915 A * 10/2000 Wagner ..... B65D 81/3883 62/457.3
6,250,005 B1 * 6/2001 Richards ..... B65D 25/36 150/901
6,581,972 B2 * 6/2003 Nojima ..... G09F 3/04 215/12.1
7,021,594 B2 * 4/2006 Exler ..... A47G 23/0225 248/205.2
7,172,668 B2 * 2/2007 Key ..... B65C 9/20 156/247
7,971,710 B1 * 7/2011 Zaher ..... A63B 71/0672 206/216
8,365,947 B2 * 2/2013 Solomon ..... B65D 23/0842 220/738
2004/0128877 A1 * 7/2004 Luedde ..... B65D 25/36 40/306
2004/0205989 A1 * 10/2004 Michaels ..... G09F 3/14 40/310
2007/0246522 A1 * 10/2007 Geeting ..... B65D 81/3879 229/403
2008/0010874 A1 * 1/2008 Londino ..... A61J 7/04 40/310
2008/0053109 A1 * 3/2008 Quincy ..... F25D 5/02 62/4
2009/0183299 A1 * 7/2009 Conway ..... A44C 5/0007 2/170
2010/0095948 A1 * 4/2010 Christy ..... A47J 36/2411 126/263.01
2010/0301061 A1 * 12/2010 Clark ..... A47G 19/2288 220/703
2013/0001122 A1 * 1/2013 Nowzari ..... B65D 23/085 206/459.5

* cited by examiner

*Primary Examiner* — Gary Hoge
(74) *Attorney, Agent, or Firm* — Albert Bordas, P.A.

(57) ABSTRACT

A sleeve system for beverage containers, having a face with a transparent section that secures onto a beverage container having a measurement scale. The measurement scale is visible through the transparent section to determine how much matter is therein. The face is defined by first and second edges, and first and second lateral edges. A hook-fastening rear section extends towards a third edge. A loop-fastening section extends towards a fourth edge. The face has a illustration section with text having information, song lyrics, short stories, rhymes, poems, and/or messages. The illustration section also has a graphic having illustrations, pictures, images and/or representations associated with the information, song lyrics, short stories, rhymes, poems, or any other messages of the text.

18 Claims, 4 Drawing Sheets

SLEEVE SYSTEM FOR BEVERAGE CONTAINERS

BACKGROUND OF THE INVENTION

1. Field of the Invention

The present invention relates to accessories for drinking containers, and more particularly, to a sleeve system for beverage containers.

2. Description of the Related Art

Several beverage container sleeves have been designed in the past. However, they have been primarily designed for thermal insulation, decoration, and gripping. Applicant is not aware of any prior art suggesting the novel features of the present invention.

SUMMARY OF THE INVENTION

The instant invention is a sleeve system for beverage containers. More specifically, the present invention is a sleeve system for beverage containers, comprising a first face having a transparent section and securing onto a beverage container comprising a measurement scale. The measurement scale is visible through the transparent section to determine how much matter is inside the beverage container. The first face is defined by first and second edges, and first and second lateral edges. In a preferred embodiment, the first face is rectangular in shape. Extending from the first edge is a hook-fastening rear section that extends a first predetermined distance to a third edge. Extending from the second edge is a loop-fastening section that extends a second predetermined distance to fourth edge. Positioned on the first face in between the third and fourth edges is the transparent section. The first face comprises a first illustration section comprising first text having first information, song lyrics, short stories, rhymes, poems, and/or messages. The first illustration section also comprises a first graphic having first illustrations, pictures, images and/or representations associated with the first information, song lyrics, short stories, rhymes, poems, or any other messages of the first text.

The present invention further comprises a second face also defined by the first and second edges, and the first and second lateral edges. Extending from the first edge is a hook-fastening section that extends the first predetermined distance to the third edge. Extending from the second edge is a loop-fastening rear section that extends the second predetermined distance to the fourth edge. The second face may comprise a second illustration section. The second illustration section comprises second text having second information, song lyrics, short stories, rhymes, poems, and/or messages. The second illustration section also comprises a second graphic having second illustrations, pictures, images and/or representations associated with the second information, song lyrics, short stories, rhymes, poems, and/or messages of the second text. The first and second illustration sections may be different.

The first face comprises the loop-fastening section and the hook-fastening rear section, and the second face comprises the loop-fastening rear section and the hook-fastening section. The first and second faces may be transparent. The first and second faces secure onto the beverage container, whereby the loop-fastening section and the hook-fastening section are aligned and biased towards each other as fastening means. The first and second faces secure onto the beverage container in a sufficiently tight manner to remain thereon and not slide/slip off.

The beverage container comprises a bottle having a base, and a cap ring with a nipple, and the matter is milk, formula, water, juice, and/or liquid/semi-liquid matter.

It is therefore one of the main objects of the present invention to provide a sleeve system for beverage containers.

It is another object of this invention to provide a sleeve system that is removably mounted to beverage containers.

It is another object of this invention to provide a sleeve system for beverage containers that may include interchangeable information comprising song lyrics, short stories, rhymes, poems, or any other messages to be read by a user while using the beverage container.

It is another object of this invention to provide a sleeve system for beverage containers that may include interchangeable illustrations, pictures, images or representations associated with the song lyrics, short stories, rhymes, poems, or any other messages to be read by the user while using the beverage container.

It is another object of this invention to provide a sleeve system for beverage containers comprising a transparent window, through which the user can see how much matter is inside the beverage container.

It is another object of this invention to provide a reversible and/or reusable sleeve system for beverage containers.

It is another object of this invention to provide a sleeve system for beverage containers that may be manufactured according to the beverage container size.

It is another object of this invention to provide a sleeve system for beverage containers that is volumetrically efficient for carrying, transporting, and storage.

It is another object of this invention to provide a sleeve system for beverage containers that can be readily mounted and dismounted without the need of any special tools.

It is another object of this invention to provide a sleeve system for beverage containers, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
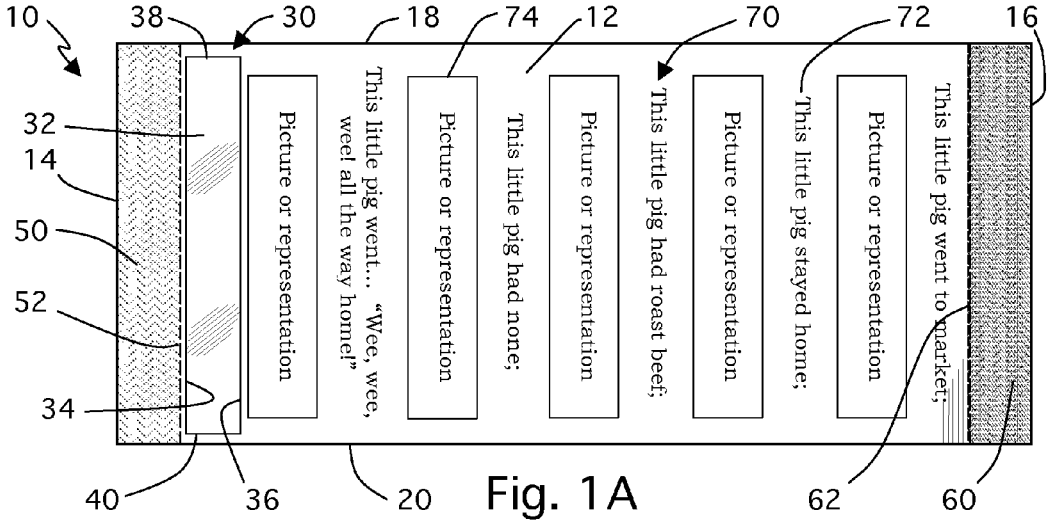
FIG. 1A represents a front view of a sleeve system for beverage containers.

Referring now to the drawings, the present invention is generally referred to with numeral 10. It can be observed that it basically includes transparent section 30 and illustration section 70.

Figure 1B:
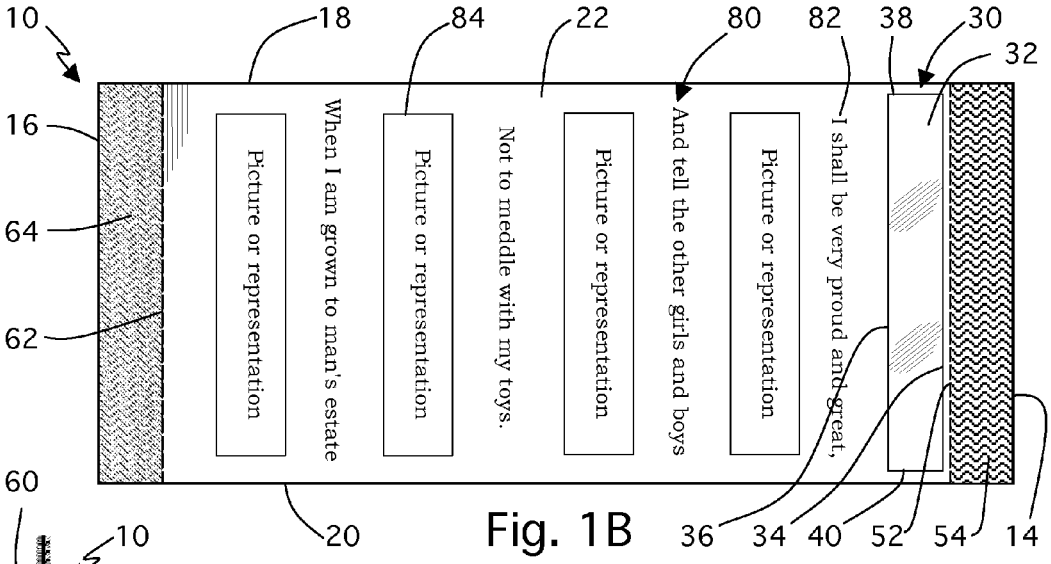
FIG. 1B is a rear view of the present invention.

As seen in FIGS. 1A and 1B, present invention 10 comprises face 12 defined by edges 14 and 16, and lateral edges 18 and 20. In a preferred embodiment, present invention 10 is rectangular in shape. Extending from edge 14 is hook-fastening rear section 50 that extends a predetermined distance to edge 52. Extending from edge 16 is loop-fastening section 60 that extends a predetermined distance to edge 62. Positioned on face 12 in between edges 52 and 62 is transparent section 30 that comprises transparent window 32. Transparent window 32 is defined by edges 34 and 36, and lateral edges 38 and 40. Transparent window 32 extends, without reaching, lateral edges 18 and 20. Face 12 comprises illustration section 70. Illustration section 70 comprises text 72 having information including, but not limited to, song lyrics, short stories, rhymes, poems, or any other messages to be read by a user. Illustration section 70 also comprises graphic 74 having illustrations, pictures, images or representations associated with the song lyrics, short stories, rhymes, poems, or any other messages of text 72 to be read by the user.

As seen in FIG. 1B, present invention 10 further comprises face 22, also defined by edges 14 and 16, and lateral edges 18 and 20. Extending from edge 14 is hook-fastening section 54 that extends a predetermined distance to edge 52. Extending from edge 16 is loop-fastening rear section 64 that extends a predetermined distance to edge 62. Face 22 comprises illustration section 80. Illustration section 80 comprises text 82 having information including, but not limited to, song lyrics, short stories, rhymes, poems, or any other messages to be read by a user. Illustration section 80 also comprises graphic 84 having illustrations, pictures, images or representations associated with the song lyrics, short stories, rhymes, poems, or any other messages of text 82 to be read by the user. In one embodiment, illustration sections 70 and 80 are different stories to read for entertainment.

Figure 1C:
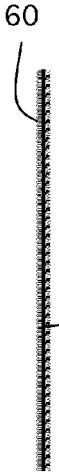
FIG. 1C is a side view of the present invention.
Figure 1D:
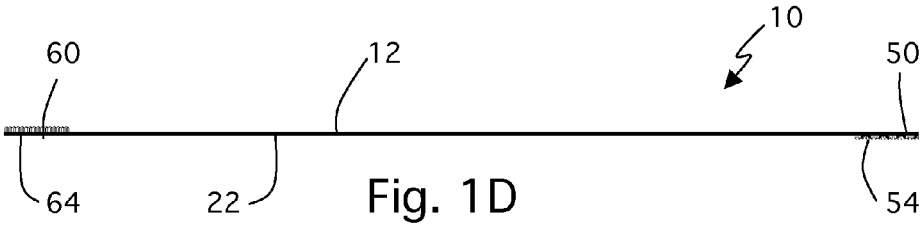
FIG. 1D is a top view of the present invention.

As seen in FIGS. 1C and 1D, in a preferred embodiment, present invention 10 comprises hook-fastening section 54 and loop-fastening section 60. More specifically, face 12 comprises loop-fastening section 60 and hook-fastening rear section 50, and face 22 comprises loop-fastening rear section 64 and hook-fastening section 54.

Figure 2A:
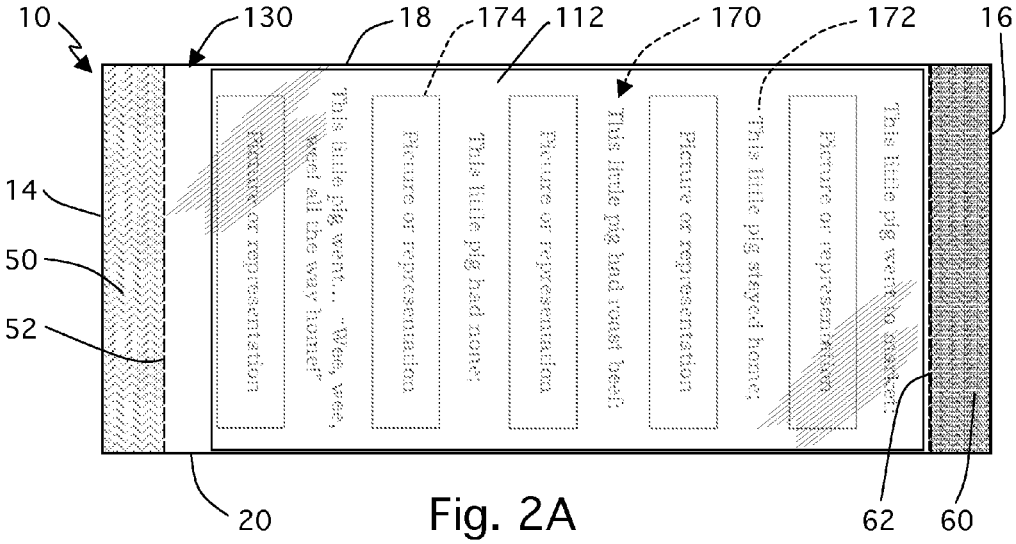
FIG. 2A represents a front view of a first alternate embodiment sleeve system for beverage containers.
Figure 2B:
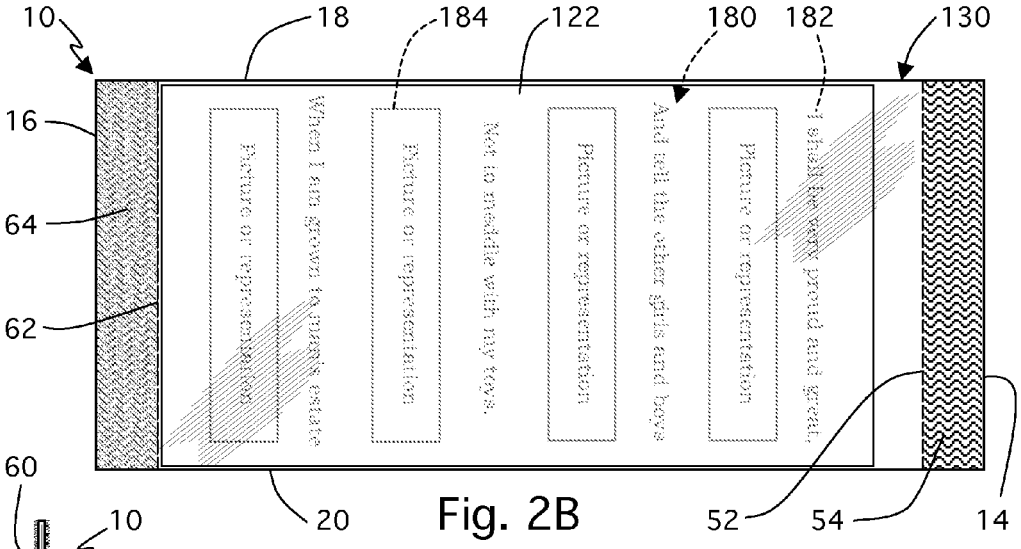
FIG. 2B is a rear view of the first alternate embodiment sleeve system for beverage containers illustrated in FIG. 2A.

Seen in FIGS. 2A and 2B is a first alternate embodiment of present invention 10 comprising transparent face 112 defined by edges 14 and 16, and lateral edges 18 and 20. Extending from edge 14 is hook-fastening rear section 50 that extends a predetermined distance to edge 52. Extending from edge 16 is loop-fastening section 60 that extends a predetermined distance to edge 62. Positioned on transparent face 112 in between edges 52 and 62 is transparent section 130. Transparent section 130 extends, without reaching, lateral edges 18 and 20.

Housed between transparent face 112 and transparent face 122 is illustration insert 170. Illustration insert 170 comprises text 172 having information including, but not limited to, song lyrics, short stories, rhymes, poems, or any other messages to be read by a user. Illustration insert 170 also comprises graphic 174 having illustrations, pictures, images or representations associated with the song lyrics, short stories, rhymes, poems, or any other messages of text 172 to be read by the user.

As seen in FIG. 2B, present invention 10 further comprises transparent face 122, also defined by edges 14 and 16, and lateral edges 18 and 20. Extending from edge 14 is hook-fastening section 54 that extends a predetermined distance to edge 52. Extending from edge 16 is loop-fastening rear section 64 that extends a predetermined distance to edge 62.

Housed in between transparent face 112 and transparent face 122 is illustration insert 180. Illustration insert 180 comprises text 182 having information including, but not limited to, song lyrics, short stories, rhymes, poems, or any other messages to be read by a user. Illustration insert 180 also comprises graphic 184 having illustrations, pictures, images or representations associated with the song lyrics, short stories, rhymes, poems, or any other messages of text 182 to be read by the user. In one embodiment, illustration inserts 170 and 180 are different stories to read for entertainment. In one embodiment, illustration inserts 170 and 180 are permanently housed within present invention 10. In another embodiment, lateral edges 18 and/or 20 serve as an access to remove and replace illustration insert 170 and/or 180.

Figure 2C:
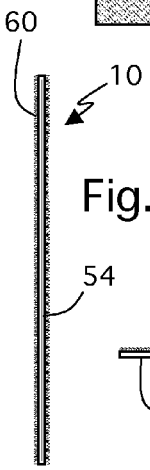
FIG. 2C is a side view of the first alternate embodiment sleeve system for beverage containers illustrated in FIG. 2A.
Figure 2D:
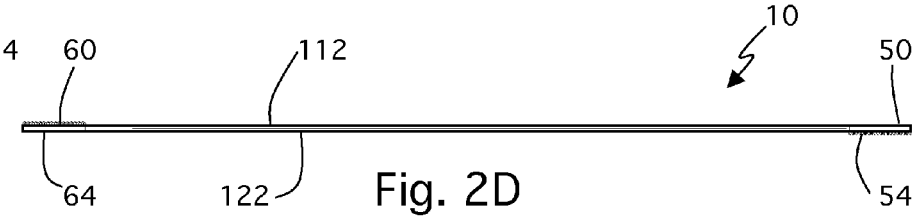
FIG. 2D is a top view of the first alternate embodiment sleeve system for beverage containers illustrated in FIG. 2A.

As seen in FIGS. 2C and 2D, in a preferred embodiment, present invention 10 comprises hook-fastening section 54 and loop-fastening section 60. More specifically, transparent face 112 comprises loop-fastening section 60 and hook-fastening rear section 50, and transparent face 122 comprises loop-fastening rear section 64 and hook-fastening section 54.

Figure 3:
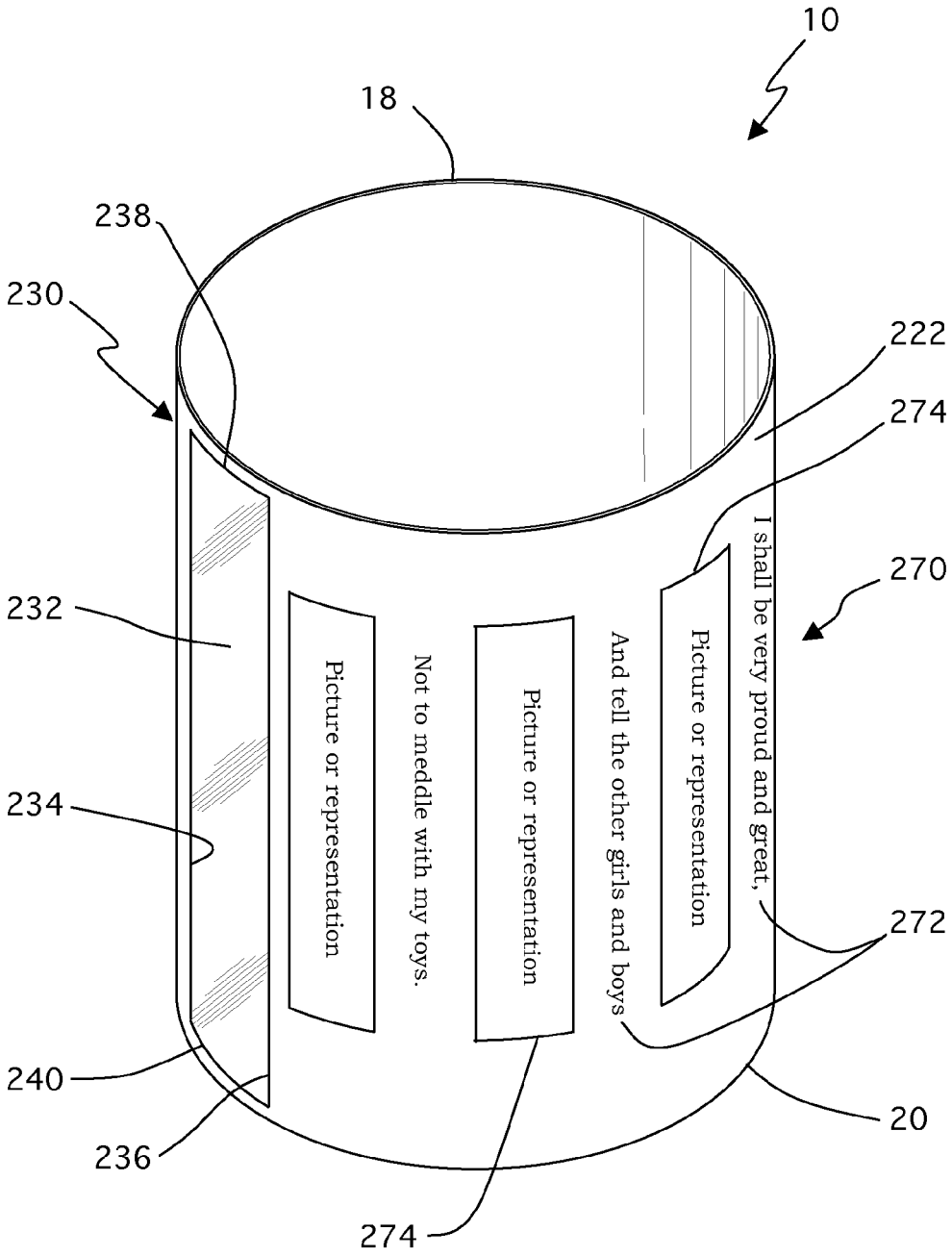
FIG. 3 represents an isometric view of a second alternate embodiment sleeve system for beverage containers.

Seen in FIG. 3 is a second alternate embodiment of present invention 10 comprising face 222 defined by lateral edges 18 and 20. Positioned on face 222 is transparent section 230 that comprises transparent window 232. Transparent window 232 is defined by edges 234 and 236, and lateral edges 238 and 240. Transparent section 230 extends, without reaching, lateral edges 18 and 20. Face 222 comprises illustration section 270. Illustration section 270 comprises text 272 having information including, but not limited to, song lyrics, short stories, rhymes, poems, or any other messages to be read by a user. Face 222 also comprises graphic 274 having illustrations, pictures, images or representations associated with the song lyrics, short stories, rhymes, poems, or any other messages of text 272 to be read by the user. Present invention 10 is secured onto beverage container 300, seen in FIG. 4, in a sufficiently tight manner to remain thereon and not slide/slip off.

Figure 4:
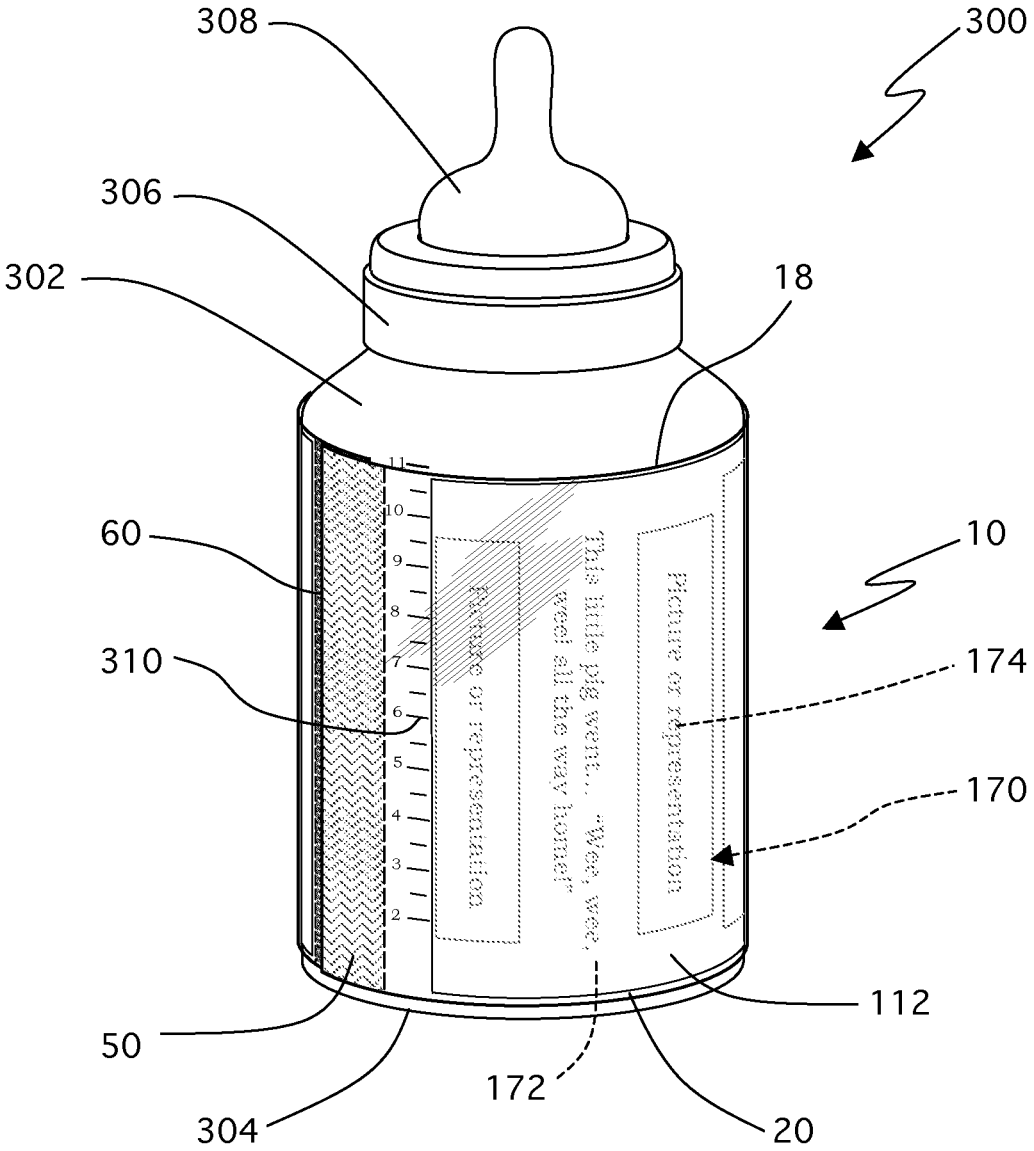
FIG. 4 represents an isometric view of the sleeve system for beverage containers illustrated in FIG. 1A, mounted onto a beverage container.

Seen in FIG. 4 is present invention 10 mounted onto a beverage container. Such a beverage container can be for example beverage container 300 comprising bottle 302 having cap ring 306 with nipple 308. Bottle 302 also has base 304 and measurement scale 310. In a preferred embodiment, present invention 10 is secured onto beverage container 300 whereby loop-fastening section 60 and hook-fastening section 54 are aligned and biased towards each other as fastening means. Present invention 10 is secured onto beverage container 300 in a sufficiently tight manner to remain thereon and not slide/slip off.

Present invention 10 is used to entertain an infant, toddler, or person while feeding from beverage container 300, whereby the person feeding the infant, toddler, or person will read from illustration section 70, 80, or 270, or illustration inserts 170 and/or 180 comprising text 72, 82, or 272, or 172 and/or 182 respectively having information including, but not limited to, song lyrics, short stories, rhymes, poems, or any other messages, and/or from graphic 74, 84, or 274, or 174 and/or 184 respectively having illustrations, pictures, images or representations associated with the song lyrics, short stories, rhymes, poems, or any other messages of text 72, 82, or 272, or 174 and/or 184 respectively.

In addition, the person feeding the infant, toddler, or person is able to read measurement scale 310 through transparent section 30, 130, and 230 to determine how much matter is inside beverage container 300. Such matter can be, but is not limited to, milk, formula, water, juice, or any other liquid/semi-liquid matter.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sleeve system for beverage containers, comprising:

A) a first face having a transparent section and securing onto a beverage container comprising a measurement scale, said measurement scale is visible through said transparent section to determine how much matter is inside said beverage container, said first face is defined by first and second edges, and first and second lateral edges; and B) a second face also defined by said first and second edges, said first and second faces are transparent and house at least one removable illustration insert.

2. The sleeve system for beverage containers set forth in claim 1, further characterized in that said first face is rectangular in shape.

3. The sleeve system for beverage containers set forth in claim 1, further characterized in that extending from said first edge is a hook-fastening rear section that extends a first predetermined distance to a third edge.

4. The sleeve system for beverage containers set forth in claim 1, further characterized in that said beverage container comprises a bottle having a base, and a cap ring with a nipple, and said matter is milk, formula, water, juice, and/or liquid/semi-liquid matter.

5. The sleeve system for beverage containers set forth in claim 3, further characterized in that extending from said second edge is a loop-fastening section that extends a second predetermined distance to fourth edge.

6. The sleeve system for beverage containers set forth in claim 5, further characterized in that positioned on said first face in between said third and fourth edges is said transparent section.

7. The sleeve system for beverage containers set forth in claim 5, further characterized in that said first face comprises a first illustration section comprising first text having first information, song lyrics, short stories, rhymes, poems, and/or messages.

8. The sleeve system for beverage containers set forth in claim 7, further characterized in that said first illustration section also comprises a first graphic having first illustrations, pictures, images and/or representations associated with said first information, song lyrics, short stories, rhymes, poems, or any other messages of said first text.

9. The sleeve system for beverage containers set forth in claim 8, further comprising a second face also defined by said first and second edges, and said first and second lateral edges.

10. The sleeve system for beverage containers set forth in claim 9, further characterized in that extending from said first edge is a hook-fastening section that extends said first predetermined distance to said third edge.

11. The sleeve system for beverage containers set forth in claim 10, further characterized in that extending from said second edge is a loop-fastening rear section that extends said second predetermined distance to said fourth edge.

12. The sleeve system for beverage containers set forth in claim 11, further characterized in that said first face comprises said loop-fastening section and said hook-fastening rear section, and said second face comprises said loop-fastening rear section and said hook-fastening section.

13. The sleeve system for beverage containers set forth in claim 10, further characterized in that said first and second faces secure onto said beverage container whereby said loop-fastening section and said hook-fastening section are aligned and biased towards each other as fastening means.

14. The sleeve system for beverage containers set forth in claim 9, further characterized in that said second face comprises a second illustration section.

15. The sleeve system for beverage containers set forth in claim 14, further characterized in that said second illustration section comprising second text having second information, song lyrics, short stories, rhymes, poems, and/or messages.

16. The sleeve system for beverage containers set forth in claim 15, further characterized in that said second illustration section also comprises a second graphic having second illustrations, pictures, images and/or representations associated with said second information, song lyrics, short stories, rhymes, poems, and/or messages of said second text.

17. The sleeve system for beverage containers set forth in claim 14, further characterized in that said first and second illustration sections are different.

18. The sleeve system for beverage containers set forth in claim 9, further characterized in that said first and second faces secure onto said beverage container in a sufficiently tight manner to remain thereon and not slide/slip off.

* * * * *